US005632149A

United States Patent [19]

Tanigawa et al.

[11] Patent Number: 5,632,149

[45] Date of Patent: May 27, 1997

[54] HEAT EXCHANGER FOR A GAS COMPRESSION/EXPANSION APPARATUS AND A METHOD OF MANUFACTURING THEREOF

[75] Inventors: Naohide Tanigawa, Nara; Tatuya Hirose, Ora-gun; Takashi Morita, Ora-gun; Kazuo Ikegami, Ora-gun; Kenichi Sato, Ora-gun, all of Japan

[73] Assignee: Sanyo Electric Company, Ltd., Moriguchi, Japan

[21] Appl. No.: 563,053

[22] Filed: Nov. 27, 1995

[30] Foreign Application Priority Data

Nov. 28, 1994 [JP] Japan ..... 6-316109

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS 3,719,051 3/1973 Malaker ..... 62/6
4,206,609 6/1980 Durenec ..... 62/6
5,259,197 11/1993 Byung-Mu ..... 62/6
5,465,579 11/1995 Terada et al. ..... 62/6
5,505,047 4/1996 Hirose et al. ..... 62/6

*Primary Examiner*—Christopher Kilner

*Attorney, Agent, or Firm*—Armstong, Westerman Hattori, McLeland & Naughton

[57] ABSTRACT

An improved heat exchanger for use in a gas compression/expansion apparatus. The heat exchanger comprises: a tube connected with a compression/expansion space of a compression/expansion cylinder of the apparatus; a central cylinder coaxially disposed in the tube such that a narrow gap for the working gas is formed only between the central cylinder and the tube. The heat exchanger may liberate heat from, or providing heat to, the compression/expansion cylinder through heat transfer between the working gas in the tube and an ambient medium surrounding said tube. The heat exchanger is capable to serve as a low/high temperature heat source for an external heat load.

11 Claims, 9 Drawing Sheets

HEAT EXCHANGER FOR A GAS COMPRESSION/EXPANSION APPARATUS AND A METHOD OF MANUFACTURING THEREOF

FIELD OF THE INVENTION

The invention relates to a heat exchanger for use in such cyclic engines, as a Stirling engine, a Builleumier engine, and a Pulse tube refrigerator, which operate to compress/expand a working gas, and a method of manufacturing such a heat exchanger.

KNOWN ART

Those heat engines or refrigerators mentioned above have a compression cylinder and an expansion cylinder. A heat exchanger for use in such engines is required to meet two seemingly contradictory requirements. The first of the requirements is to have a maximum compression ratio of the gas (which is defined by maximum pressure difference divided by minimum pressure experienced in one cycle, and is a relevant measure of thermal efficiency of the thermal system of interest) by minimizing "dead spaces" or spaces, outside the compression and expansion cylinders, holding a volume of the working gas which is not presently participating in a compression or an expansion process nor a heat transfer process. Such dead spaces result in gas transport tubes connecting the compression cylinder and the expansion cylinder. Therefore, minimization of the dead spaces will lead to maximization of the amount of the working gas participating in the compression/expansion processes, and hence maximization of the compression ratio. The second requirement is to provide a maximum heat transfer area for the heat exchanger for an improved heat transfer coefficient of the apparatus. However, the heat transfer area cannot be arbitrarily increased because an increased heat transfer area often accompanies a dead space inside the heat exchanger.

One prior art solution for the contradictory requirements mentioned above is a provision of a heat exchanger as shown in FIG. 9, in which a working gas is passed through a planar array of many parallel tubes 1 in the direction indicated by arrows for heat transfer between the heat exchanger and an ambient medium. Another prior art solution is a block of metal 2 having a multiplicity of elongate bores or passages 3 for the working gas to exchange heat with a medium surrounding the block. The block is made of a metal having good thermal conductivity such as an aluminum alloy.

These prior art heat exchangers, however, have rather complex structures and are difficult to manufacture at low cost.

It is therefore an object of the present invention to provide a heat exchanger which has reduced dead spaces and increased thermal efficiency.

It is another object of the present invention to provide a heat exchanger which is simple in structure.

It is still another object of the present invention to provide a method of manufacturing such improved heat exchanger economically.

SUMMARY OF THE INVENTION

According to one aspect of the invention, there is provided a heat exchanger thermally coupled with a compression/expansion space of a gas compression/expansion cylinder belonging to a compression/expansion apparatus, the heat exchanger including:

a tube connected with the compression/expansion space of the compression/expansion cylinder;

a central cylinder coaxially disposed in the tube such that a narrow gap for the working gas is formed only between the central cylinder and the tube, wherein the heat exchanger is adapted to serve as a low/high temperature heat source by liberating heat from, or providing heat to, the compression/expansion space of one cylinder through heat transfer between the working gas in the tube and an ambient medium surrounding the tube.

In this heat exchanger, the working gas is passed through the narrow gap provided between the outer tube and the inner cylinder for heat transfer. This is structurally simpler than conventional heat exchangers. It should be noted that this heat exchanger has a great heat transfer area on the outer tube, and yet has a reduced amount of dead spaces in the tube due to the central cylinder, and hence an increased compression ratio of the gas in the compression/expansion space. Thus, the heat exchanger has an improved thermal efficiency. These features permit a heat exchanger for generating a high/lower temperature source to be manufactured economically.

According to another aspect of the invention, there is provided a heat exchanger which, in addition to the features described above, has a feature that the tube and the central cylinder are made of flexible materials.

This type of heat exchanger is deformable to provide an optimum heat transfer for a specific thermal system having a given spatial configuration.

In a further aspect of the invention, there is provided a heat exchanger which has, in addition to the above mentioned feature, a further feature that a multiplicity of fins are fitted on the exterior surface of the tube. It is apparent that these fins enhance heat transfer of the heat exchanger, and further improve the thermal efficiency of the heat exchanger.

In a still further aspect of the invention, to provide a heat exchanger as described above, wherein the fins are mounted on the tube by the method steps of:

a first step of placing of the fins on a drawing bench having a hole slightly larger in diameter than the outer diameter of the tube, a circular fin having a central hole of a given inner diameter which is smaller than the outer diameter of the tube by a predetermined length; a second step of pressing the tube into the hole of the fin until the fin is fitted on a predetermined position of the tube; and repeating the first and second steps until a predetermined number of fins are fitted on the tube.

The heat exchanger having this feature may be manufactured in a simple manner and at low cost, since the fins are easily mounted on the tube by simply pressing the tube into fins placed on a drawing bench by a press machine for example.

In a still further aspect of the invention, there is provided a heat exchanger thermally coupled with a compression/expansion space of a gas compression/expansion cylinder belonging to a compression/expansion apparatus, the heat exchanger including:

a cap member covering the compression/expansion cylinder such that a narrow gap for the working gas to pass through is formed only between the cap member and the compression/expansion cylinder, the narrow gap communicates with the compression/expansion space and is accessible from an opening of the gap, wherein the heat exchanger is adapted to serve as a low/high temperature heat source by liberating heat from, or providing heat to, the compression/expansion space of the cylinder through heat transfer between the working gas in the gap and an ambient medium surrounding the cap. The heat exchanger of this type has a reduced dead space in the gap while keeping an increased heat transfer area for the gas, thereby providing a large compression ratio and a large heat transfer coefficient for the apparatus. It should be noted that the heat exchanger extends over a region of the cap between the expansion cylinder and she machinery room. This implies that no independent space is needed for the heat exchanger and hence that the compression/expansion apparatus may have a simple and compact structure.

The heat exchanger described above may have a multiplicity of fins fitted on the exterior surface of the cap member.

It would be appreciated that these fins may accelerate heat transfer between the heat exchanger and the surrounding medium.

In a still further aspect of the invention, there is provided a heat exchanger for use in a gas compression/expansion apparatus, the heat exchanger serving as a high/low temperature heat source by transferring heat between a working gas in a compression/expansion space of a compression/expansion cylinder of the apparatus, the working gas compressed/expanded in the compression/expansion space by a piston driven by a crank mechanism in a machinery room, the heat exchanger comprising:

a regenerator surrounding the cylindrical outer surface of the cylinder;

an exterior cover for covering the regenerator and the cylinder, the cylinder having an opening at the distal end thereof;

a partition member which surrounds a piston rod connected with the piston and is disposed between the cylinder and the machinery room, such that a narrow gap is formed between the partition member and the cover for allowing the working gas to pass through.

This narrow gap has a very small volume, and yet allows the working gas to exchange heat with the surrounding medium outside the cover through a relatively large heat transport area. Fins may be provided on the exterior surface of the cover around the gap to further enhance heat transfer in this region. It should be noted that in those regions where the narrow gap abruptly merges at its the upper end with the lower end of the regenerator and at its lower end with the opening of the cover, the flow rate of the working gas changes abruptly, where great heat transfer is anticipated to occur. The fins surrounding these regions thus contribute to improved heat transfer. It should be noted in this example that the heat exchanger is located in the region of the cover between the expansion cylinder and the machinery room. Consequently, no independent space is needed for the heat exchanger, so that the resulting compression/expansion apparatus has a simple and compact structure.

This heat exchanger may be provided with fins fitted on the regions of the exterior surface of the cover such that the regions corresponding to: one end of the narrow gap which abruptly merges to the partition member; the length of the narrow gap; and the other end of the narrow gap which abruptly merges to an enlarged opening of the cover.

As in the preceding example, these fins may improve heat transfer coefficient of the heat exchanger in these regions.

According to still another aspect, there is provided a heat exchanger for use in a gas compression/expansion apparatus, the heat exchanger serving as a high/low temperature heat source by transferring heat between a working gas in a compression/expansion space of a compression/expansion cylinder of the apparatus, the working gas compressed/expanded in the compression/expansion space by a displacer driven by a crank mechanism in a machinery room. The heat exchanger includes: a cover which contiguous with the cylinder;

a partition member which surrounds a rod connected with the displacer and is disposed in the cover and between the cylinder and the machinery room, such that a narrow gap is formed between the partition member and the cover for allowing the working gas to pass through, the gap communicating with the compression/expansion space via the regenerator.

This heat exchanger is also capable of performing improved heat transfer as the preceding example. In addition, since the heat exchanger utilizes a displacer instead of a piston, no independent space is needed for the regenerator, thereby rendering the compression/expansion apparatus simple and compact in structure.

This heat exchanger may be also provided with fins fitted on the regions of the exterior surface of the cover, which regions corresponds to:

one end of the narrow gap which abruptly merges to the regenerator; the length of the narrow gap; and the other end of the narrow gap which abruptly merges to an enlarged opening of the cylinder.

As in the foregoing examples, these fins increase heat transfer in the heat exchanger, thereby improving the heat transfer coefficient thereof and improving the power of the compression/expansion apparatus.

The invention is now described by way of example with reference to the accompanying drawings, in which the preferred embodiments of the invention are described through applications to a Stirling refrigeration apparatus for the purpose of illustration. Like or corresponding components in these drawings are given the same reference numbers,

DETAILED DESCRIPTION OF THE PREFERRED EMBODIMENT

Figure 1:
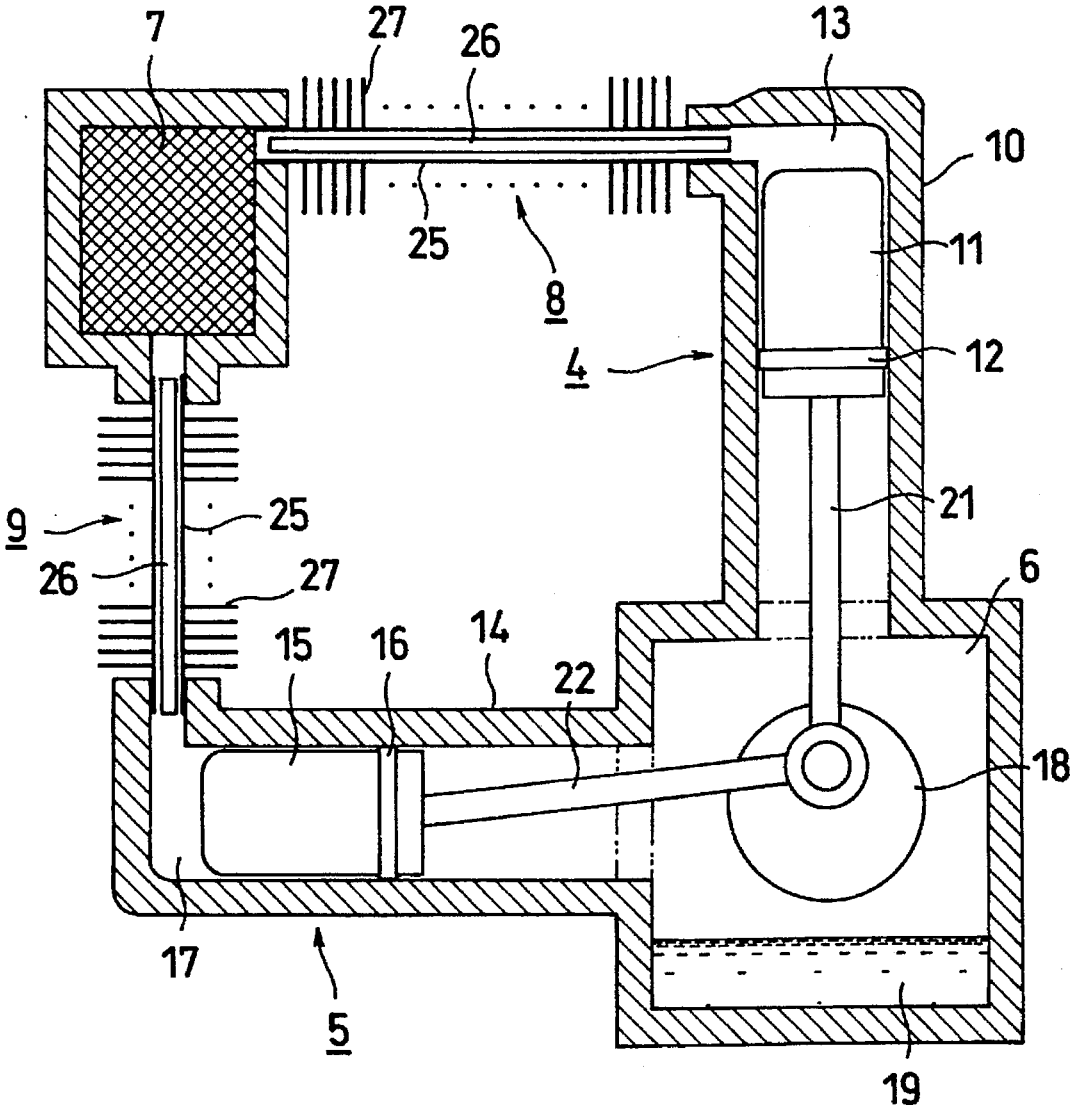
FIG. 1 is a schematic view of a first Stirling refrigeration apparatus which utilizes a heat exchanger of the invention.

Referring now to FIG. 1, there is shown a Stirling refrigeration apparatus which utilizes a heat exchanger of the present invention. This apparatus includes a gas expansion apparatus 4 (hereinafter referred to as gas expander) for adiabatically, expanding a working gas such as helium in the cylinder to lower the temperature of the gas, a gas compressor 5 for receiving the expanded working gas from the expansion cylinder and compressing the gas before it is returned to the expander 4, and a drive mechanism 18 accommodated in a machinery, room 6 for driving the gas expander 4 end the gas compressor 5 out of phase from each other, as described in detail below. Installed between the gas. expander 4 and the gas compressor 5 is a regenerator 7 for regenerating heat during the operation of the apparatus. The regenerator 7 is connected with a first heat exchanger 8 which serves as a heat sink in this example and a second heat exchanger 9 which serves as a radiator for the compressed gas. A gas passage is thus established between the gas expander 4 end the gas compressor 5 via the first heat exchanger 8, the regenerator 7, and second heat exchanger 9.

The gas expander 4 has a vertical expansion cylinder 1O and an expansion piston 11 slidably fitted in the expansion cylinder 10. The piston 11 quickly moves downward when the apparatus is in an expansion process so that the compressed gas delivered from the gas compressor 5 through the regenerator 7 is adiabatically expanded in an expansion space 13 of the cylinder 10. The piston moves upward when the apparatus is in a process of returning the expanded gas to the gas compressor 5. In this process, a compression piston 15 of the compression cylinder is moved backward (i.e. in the direction towards the proximate end of the cylinder 14 as seen from the crank mechanism 18) to receive the expanded gas. The pistons 11 and 15 are provided with piston rings 12 and 16, respectively, which defines the expansion space 13 and a compression space 17 in the forward end (i.e. the distal ends of the respective cylinders 10 and 14 as seen from the crank mechanism 18). The gas refrigerated in the expansion space 13 serves as a heat sink of the apparatus.

In a compression process the working gas is adiabatically compressed and passed to the regenerator 7 before it is passed to the gas expander 4.

Provided in the machinery room 6 are a motor (not shown) for driving the crank mechanism 18, and lubricant 19. The rotational motion of the crank mechanism 18 is transformed into linear reciprocal motions of piston rods 21 and 22 of the pistons 11 and 15, respectively, by means of any known mechanism. However, the mechanism will not be described in detail here, since it is not relevant to the invention and is well known in the art. The piston rods are driven so that the expansion piston 11 and the compression piston 15 are actuated out of phase with each other by 90 degrees. The piston rods 21 and 22 penetrate oil seals 67 which prevent the lubricant from entering rear spaces in the cylinders 10 and 14.

The regenerator 7 is cooled by the gas expanded in the expansion cylinder and returning to the compression cylinder. In the subsequent compression process, the cooled regenerator 7 cools the gas compressed in the compressor 5 and passed to the expander 4 via the regenerator 7. The regenerator 7 is a porous body allowing the working gas to pass through. It is made of such material as stainless steel, ceramics, copper, and lead.

Figure 2:
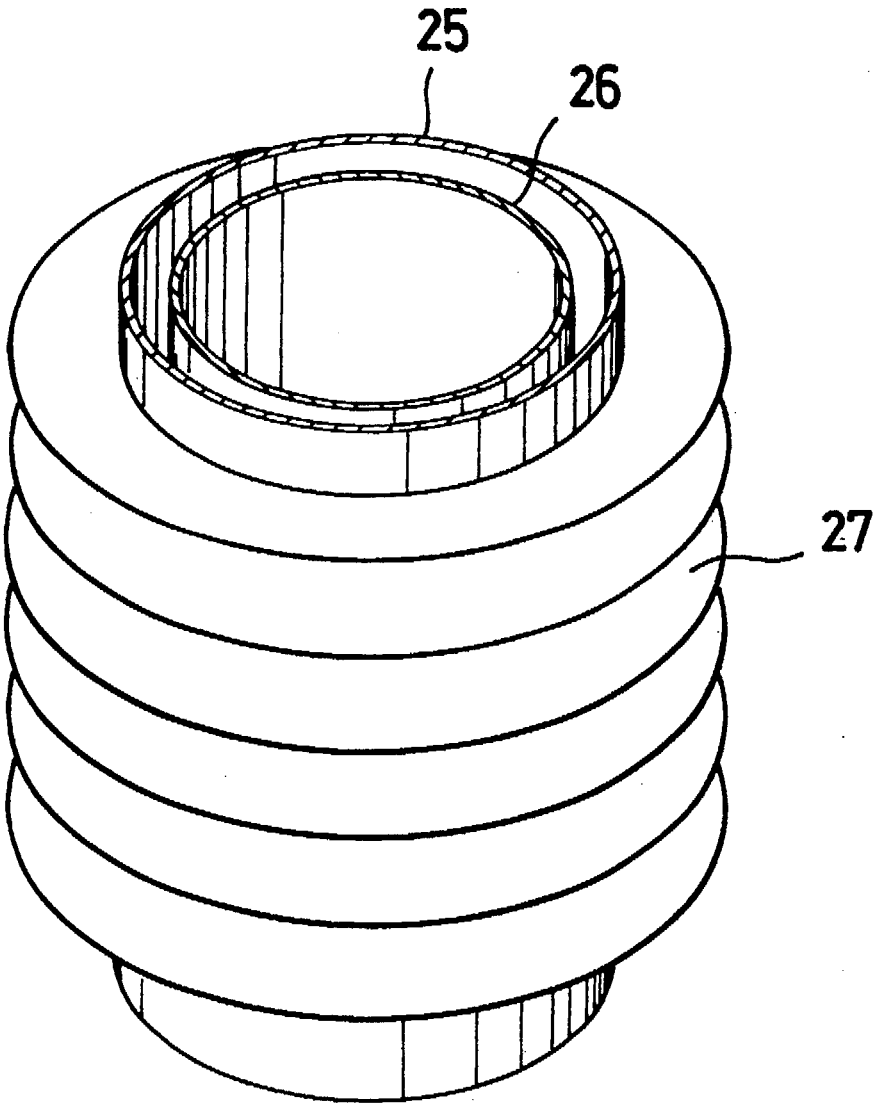
FIG. 2 is a perspective view of the heat exchanger for the Stirling refrigeration apparatus shown in FIG. 1.

The heat exchangers 8 and 9 may have the same structure as shown in FIG. 2. The heat exchanger shown in the figure is characterized by a double-walled tube, which consists of outer and inner tubes 25 and 26, respectively, and a multiplicity of radially extending fins 27 mounted on the exterior surface of the outer tube 25, as shortly will be described in detail.

The outer tube 25 is preferably made of a flexible material having good thermal conductivity. The inner tube 26 only needs to be flexible and must be sealed on the opposite ends thereof so that the working gas will not leak into the hollow space inside the tube. The inner tube may be substituted for by a flexible solid cylinder. The cross sectional areas of the inner and outer tubes need not be circular, but may be elliptic, rectangular, or of any shape. The fins 27 are preferably made of a thin material having good thermal conductivity.

Figure 3A:
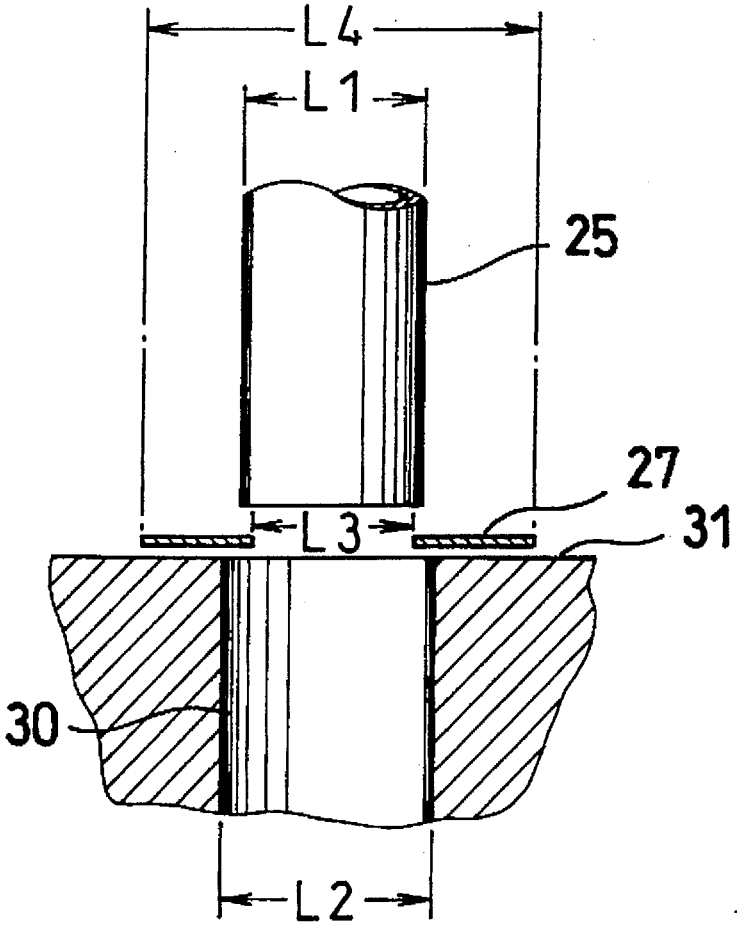
FIGS. 3A and B are partial cross sections of a tube and fins of the heat exchanger shown in FIG. 2, showing the fins before and after being fitted on the tube, respectively.
Figure 3B:
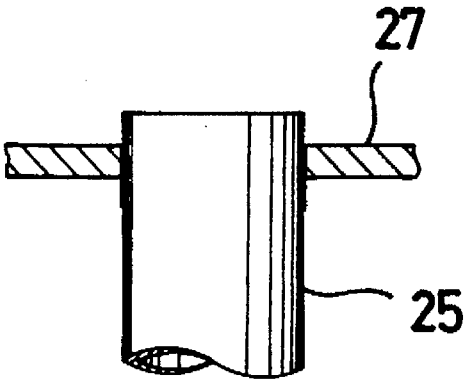

In manufacturing the heat exchangers 8 and 9 as shown in FIG. 2, a first circular fin 27 having an inner diameter L3 which is slightly smaller than the outer diameter L1 of the cylindrical tube 25 is placed on a drawing bench 31 which has a hole 30 slightly larger in diameter than the outer diameter L1 of the cylindrical tube 25, as shown in FIG. 3A. The cylindrical tube 25 is then pressed in the hole 30 of the drawing bench 31 so that the first fin is fitted on a predetermined upper most position of the cylindrical tube 25 as shown in FIG. 3B. A second fin 27 is fitted on a second predetermined position of the cylindrical tube 25 below the first fin, in the same way. In this manner a multiplicity of fins are fitted on the cylindrical tube 25. Although this method is most suited for a hard tube 25, the method may be also applied to a flexible tube by filling the tube 25 with a hard core during fitting the fins on the tube 25.

Figure 4A:
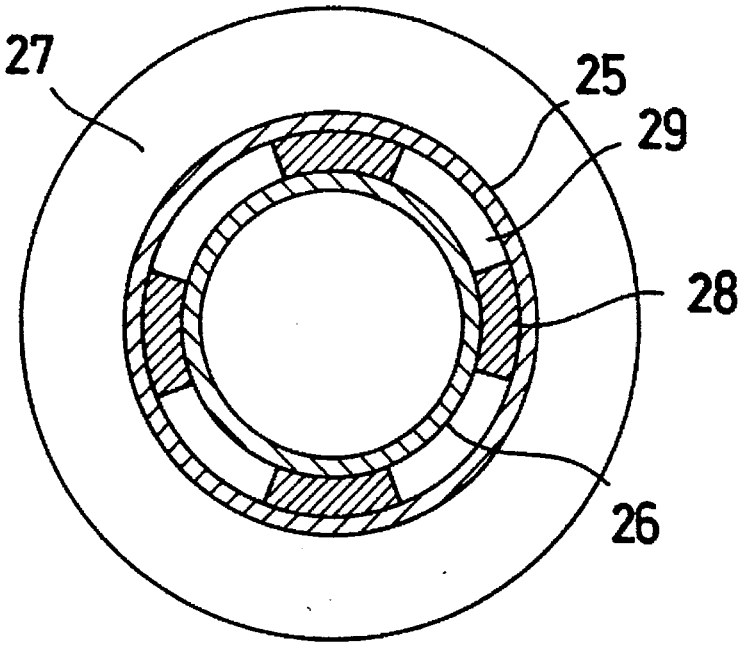
FIGS. 4A and B are partial longitudinal and transverse cross sections of the heat exchanger of FIG. 2, respectively.
Figure 4B:
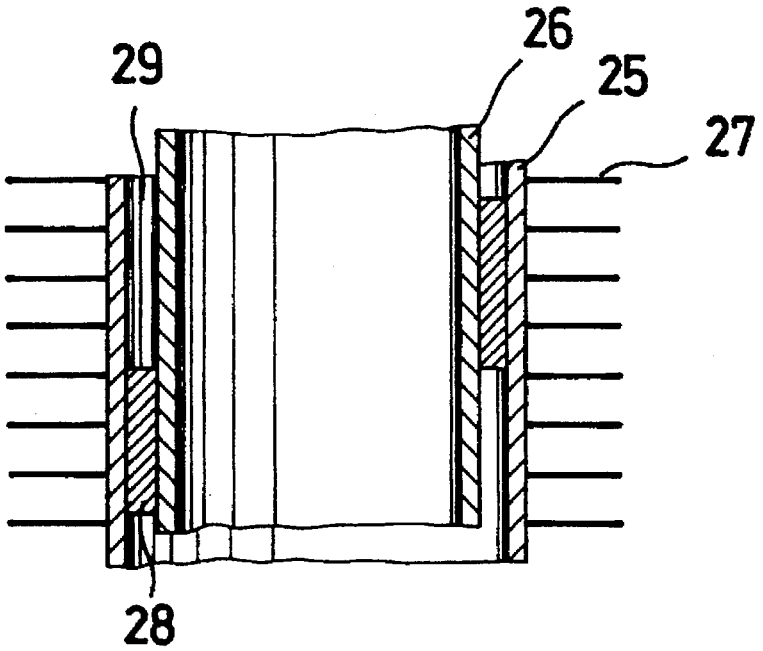

The hollow cylinder 26 is then inserted in the outer tube 25 together with spacers 28 inserted between the outer tube 25 and the inner hollow cylinder 26 so that the outer tube 25 and the inner cylinder 26 are separated by a gap 29, as shown in FIGS. 4A and 4B. The gap depends on the design of the heat exchanger. The gap in the preferred example shown herein may range from 0.05 mm to a few mm. Each of the spacers 28 nay extend along the entire length of the cylindrical tube 25 or may extend only over a finite length of the cylindrical tube 25 as shown in FIG. 4B. It would be understood that conventional heat transfer could be established around the outer tube 25 when the outer tube 25 is exposed to an ambient heat transfer medium.

In operation, as the crank mechanism 18 is actuated by the motor, the compression piston 15 of the compression cylinder 14 is moved forward, compressing the helium gas in the compression space 17. The compressed working gas is then pumped out of the compression cylinder 14 into the heat exchanger 9 serving as a heat radiator, where the gas is cooled to a temperature as low as ambient temperature, and then led to the regenerator.

The gas is further cooled in the regenerator 7 before it is delivered to the expansion space 13 of the gas expander 4. The cooled gas eventually fills the expansion space 13 to an elevated pressure.

Subsequently, an expansion process takes place, in which the expansion piston 11 of the cylinder 4 is quickly lowered in the expansion cylinder 10 while keeping the piston 15 substantially at rest. This is due to the fact that the expansion piston 11 is out of phase by 90 degrees with respect to the piston 15. This quick motion of the expansion piston 11 causes the gas in the expansion cylinder 10 to expand adiabatically and get cooled to a low temperature.

In the next step that follow the expansion process, the crank mechanism 18 raises the expansion piston 11 and then retract the piston 15 so that the cooled gas is pumped out of the expansion space 13 to the compression space 17 via the heat exchanger 8, the regenerator 7, and the heat exchanger 9. Although most of the heat absorption takes place between the heat exchanger 8 and an external load, the expanded gas still remains cold enough to cool the regenerator 7. Thus, the gas behaves as a low temperature heat source for the regenerator 7.

It should be appreciated that only a little amount of she working gas is trapped in the narrow gap between the cylindrical tube 25 and the inner hollow cylinder 26 of a heat exchanger when the gas is transported from one cylinder to the other of the compression/expansion apparatus. Thus, most of the gas is trapped in the compression and expansion cylinders. This means that a high compression ratio is obtained in the apparatus, which in turn implies that a very large temperature difference is obtained through the compression and expansion processes. It should be also appreciated that, since the heat exchanger has a large heat transfer area, it has a large heat transfer coefficient.

As the expanded gas is entirely returned to the compression space 17, the current cycle is completed. Thereafter, the next cycle is repeated by the rotational motion of the crank mechanism 18. Repetition of the cycles will gradually lower the temperature of the gas in the expansion space 13 and hence the temperature of the heat exchanger 8 and the regenerator 7. The heat exchanger 8 may then serve as a heat sink for an external load (not shown).

Figure 5:
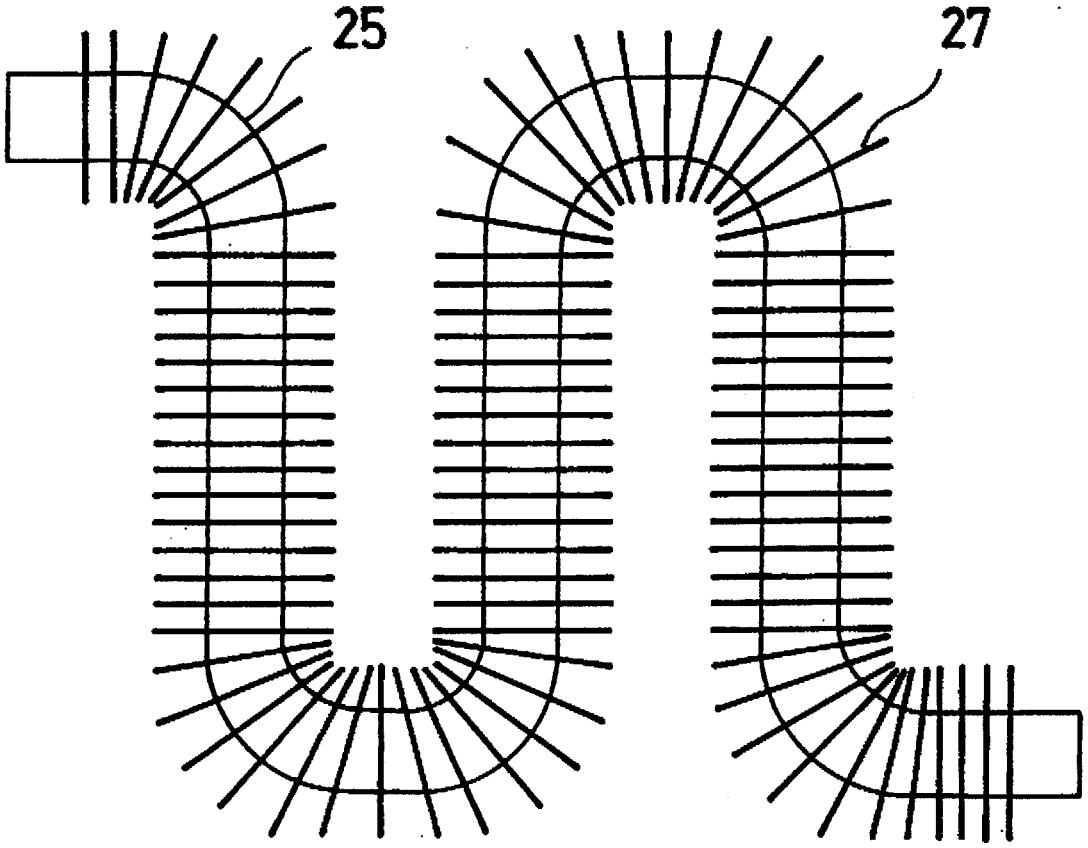
FIG. 5 is a schematic view of an alternative heat exchanger of the invention for use in the Stirling refrigeration apparatus of FIG. 1.

It is noted that the heat exchanger 8 is made of a deformable material so that it may be deformed into a desired configuration as shown in FIG. 5 suitable for a specific use.

Figure 6:
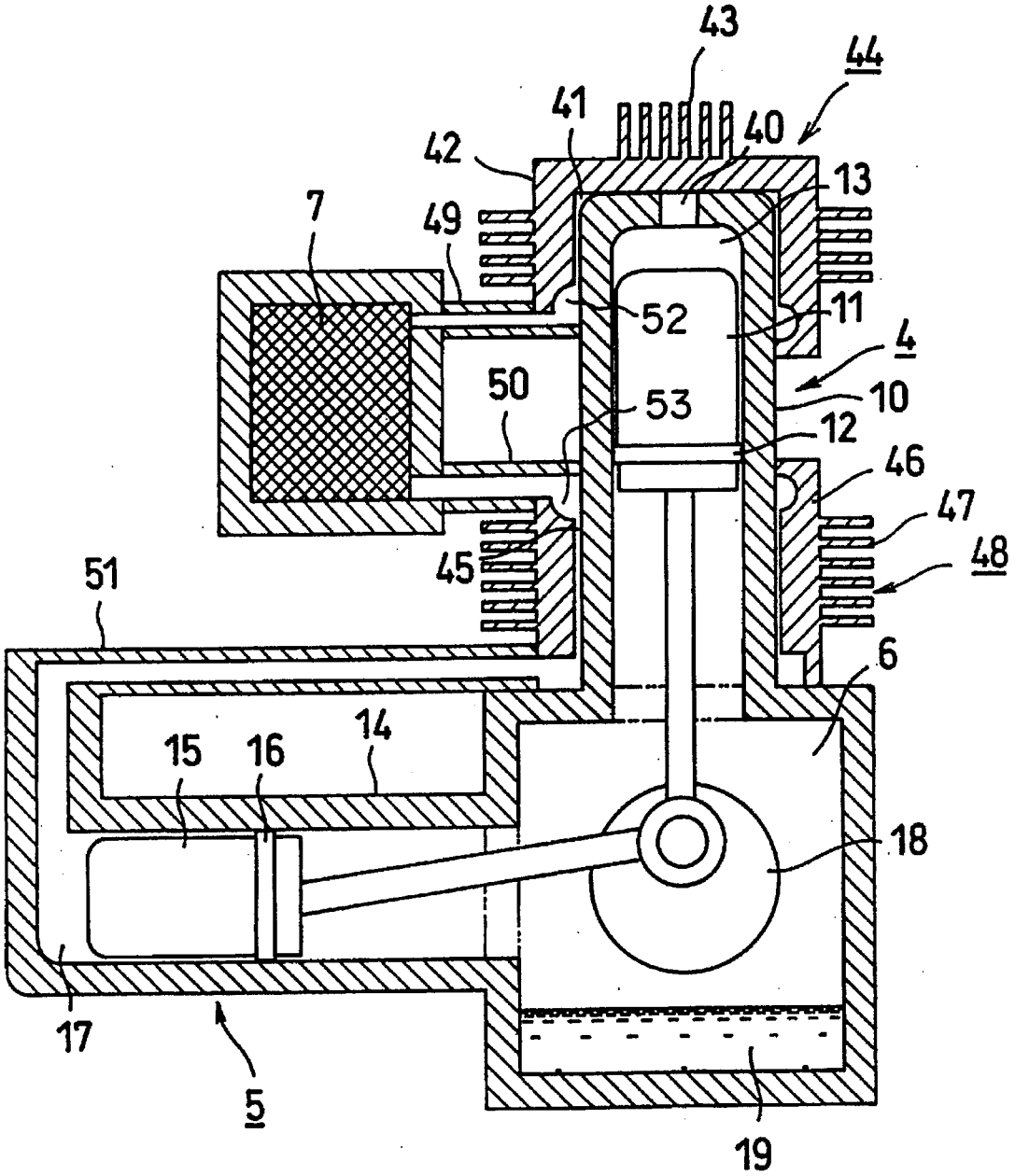
FIG. 6 is a schematic view of a Stirling refrigeration apparatus having another type of heat exchanger according to the invention.

Referring now to FIG. 6, there is shown an alternative set of heat exchangers according to the invention. In this example, an expansion cylinder 10 is made of a good thermal conductor and is provided at the top end thereof with a hole 40 for allowing the working gas to come in or go out of the expansion cylinder 10. Surrounding the top section of the expansion cylinder 10 is a cover or cap 42 which is made of a good thermal conductor and spaced apart from the expansion cylinder 10 by a predetermined distance. The cover 42 has a multiplicity of heat radiating fins 43 mounted on the outer surface thereof, altogether forming a heat exchanger 44.

On the lower section of the expansion cylinder 10 is another cover 46 which is also made of a good thermal conductor. The cover 46 also has a multiplicity of fins 47 on its outer surface, altogether forming a heat exchanger 48 for radiating heat.

A gap 41 in the heat exchanger 44 (i.e. the gap between the cover 42 and the expansion cylinder 10) communicates with a regenerator 7 through a gas transport tube 49. Similarly, the gap. 45 of the heat exchanger 48 communicates with the regenerator 7 through a gas transport tube 50. The gap 45 of the heat exchanger 48 also communicates with the compression space 17 of a gas compressor 5 through a gas transport tube 51. These gaps form a part of a gas passage for the working gas to and from the heat exchangers 44 and 48. The gaps 41, 45 are accessible through inlets 52, 53 in the covers 42, 46, respectively.

In this arrangement, the gas compressed in the compression space 17 of the gas compressor 5 is delivered to the regenerator 7 after the gas is cooled in the heat exchanger 48. The gas is further cooled in the regenerator 7 and is then introduced into the expansion space 13 of the gas expander 4 via the gap 41 and through the hole 40 of the expansion cylinder 10.

The cooled gas introduced into the expansion space 13 is subsequently expanded in the expansion cylinder 10 of the gas expander 4 when the piston 11 of the gas expander 4 is quickly lowered while the piston 15 of a compressor 5 remains at rest in a compression cylinder 14. In this way the gas expander 4 is ahead of the compressor 5 in phase by 90 degrees. The gas, therefore, undergoes an adiabatic expansion and gets further cooled.

In the next process, the cooled working gas is expelled from the expansion cylinder 10 through the hole 40 by the rising expansion piston 11.

The gas is then passed to the regenerator 7 through the gas transport tube 49. In this process the gas cools the regenerator 7 before it is returned therefrom to the compression space 17 of the gas compressor 5 via the gas transport tube 50, the heat exchanger 48, and the gas transport tube 51. The heat exchanger 44 cooled in this manner through a repetitive operation will serve as a low temperature heat source for an external heat load.

The above described cycle is basically the same as the first cycle described in connection with FIG. 1. In other words, the heat exchanger may provide an efficient low temperature heat source.

Although the invention has been herein described in connection with the heat exchanger 44 serving as a low temperature heat source, it would be apparent that the heat exchanger 44 may operate as a hot heat reservoir by simply reversing the direction of the crank mechanism 18 so that the roles of the gas compressor 5 and the gas expander 4 are interchanged. Also, it should be understood that the invention may apply equally well to other types of gas compression/expansion apparatus including a Builleumier engine and Pulse tube refrigerators.

Figure 7:
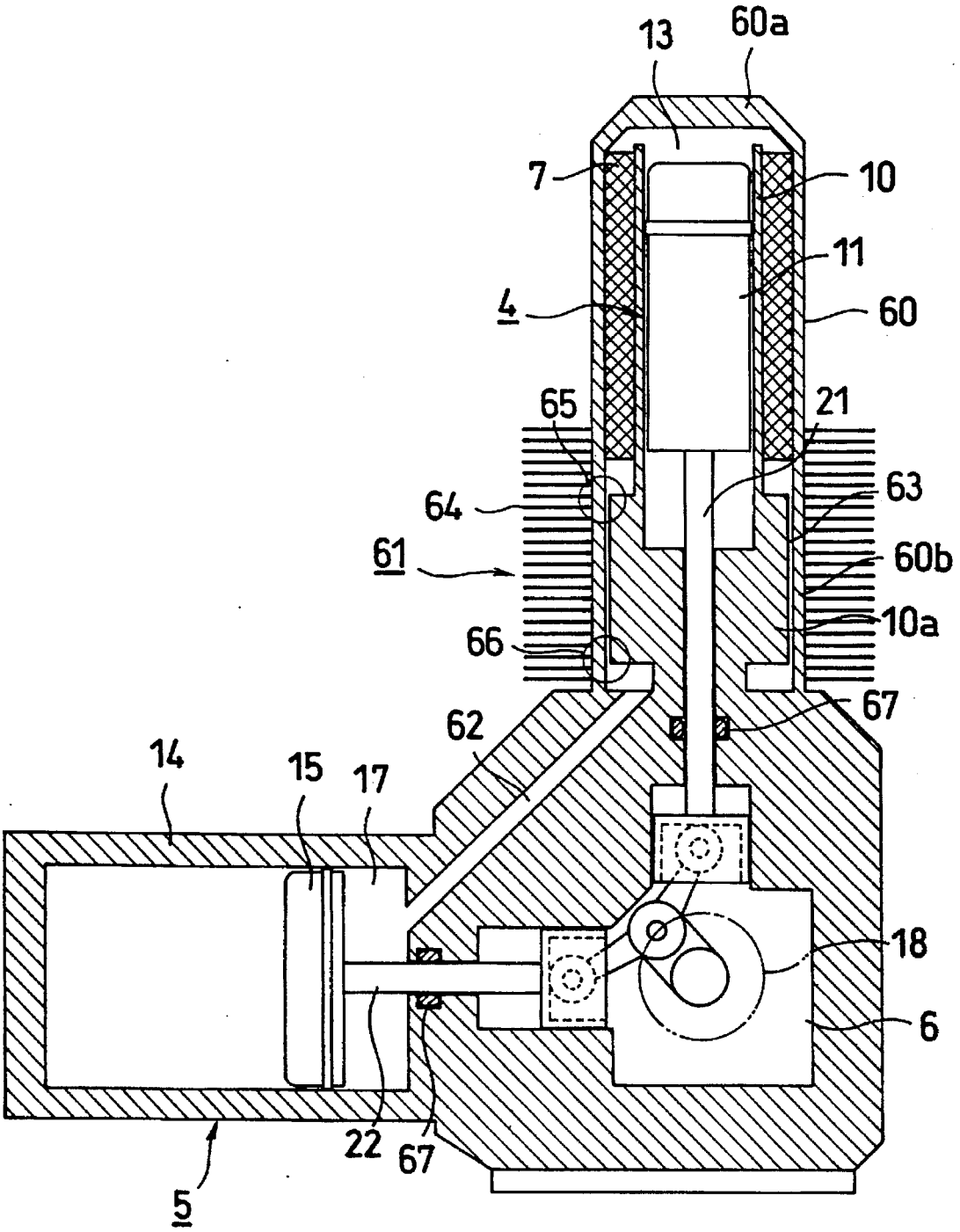
FIG. 7 is a schematic view of a Stirling refrigeration apparatus having a further type of heat exchanger according to the invention.

Referring now to FIG. 7, there is shown still another example of a Stirling refrigerator utilizing the invention. The Stirling refrigerator shown in the figure has a gas expander 4 which includes an expansion cylinder 10. The expansion cylinder is open at its top end. Inside the cylinder 10 is a reciprocal piston 11. The cylinder 10 is surrounded by a regenerator 7. The expansion cylinder 10 and the regenerator 7 are hermetically housed in a container or cover 60 made of a good thermal conductor. The regenerator 7 extends into the cover and reaches the lower end of the expansion cylinder.

The cover 60 extends beyond the lower end of the expansion cylinder, forming a heat transfer area **60*b* of a heat exchanger 61, as shown in FIG. 7. This heat exchanger serves as a heat radiator. The heat transfer area 60*b* may be provided with fins 64** for efficient heat radiation.

In order to reduce dead spaces in the passage of the working gas, a partition member **10*a* is installed in the lower section 60*b* of the cover 60 and between the expansion cylinder 10 and a machinery room 6, such that the partition member 10*a* surrounds the piston rod 21 and fills most of the inner volume of the lower section 60*b* of the container 60, leaving only a narrow gap 63 between the partition member 10*a* and the lower section 60*b* of the container 60. The narrow gap communicates at its upper end with the regenerator 7 and at its lower end with a gas transport passage 62 leading to a compressor 5. It should be noted that in transitional portions 65 and 66 of the gas passage where the narrow gap merges wider spaces adjacent the regenerator 7 and the passage 62 as shown in FIG. 7. In these regions, the flow rate of the working gas changes abruptly. It has been known in the art that such abrupt change in the flow rate may provide a large heat transfer coefficient to the heat exchanger 61**.

From this point of view, it is desirable to have fins 64 not only on the regions of the cover 60 covering the narrow gap but also on the region covering such transitional portions of the gas passage. This arrangement of the fins 64 thus greatly improves the thermal heat transfer coefficient of the heat exchanger compared to conventional ones.

The gas compressor 5 is provided with a compression space 17 between the piston 15 and the proximate end of a compression cylinder 14 (proximate as seen from the crank mechanism 18).

The machinery room 6 accommodates a crank mechanisim 18, which is connected with piston rods 21 and 22 of the pistons 11 and 15, respectively. The piston rods 21 and 22 are sealed by respective oil seals installed in the partition member 10*a*.

In operation, in the first process of a cycle, the crank mechanism 18 is driven by a motor (not shown) to reciprocate the pistons 21 and 22 in the cylinders 10 and 14 of the gas expander 4 and the gas compressor 5, respectively. During a compression process, the piston 15 recedes in the cylinder 14 compressing the working gas such as helium gas in the compression space 17 while the piston 11 is held virtually at rest at its dead point (which is the highest point) in the expansion cylinder 10. The compressed gas is then passed to the heat exchanger 61 serving as a heat radiator via the gas passage 62, where the gas liberates to the fins 64 of the heat radiator 61 its energy accumulated during the compression, and is cooled to a temperature near the ambient temperature. The gas is further passed to the regenerator 7 around the expansion cylinder 10 which was cooled in the preceding cycles.

The gas introduced in the regenerator 7 is further cooled therein before it is passed to she expansion space 13 of the gas expander 4. Since the piston 11 is held at the dead point in the expansion cylinder 10, the pressure in the expansion cylinder 10 gradually increases to a maximum value.

Subsequently, in the expansion process, the expansion piston 11 is quickly pulled down to increase the volume of the expansion space 13, causing an adiabatic expansion of the gas and resulting refrigeration of the gas to a lower temperature.

Following the adiabatic expansion, the expansion piston 11 is raised again. At the same time the piston 15 is driven forward by the crank mechanism 18, thereby recovering the expanded gas from the expansion space 13 to the compression space 17 via the regenerator 7 and the heat exchanger 61. This completes the current cycle. It would be noted that the material filling the regenerator 7 is cooled by the gas during the last process of the cycle.

In the manner as described above, the working gas is transported back and forth through the narrow gap 63 between the extended cover 60*b* and the partition member 10*a* during the cycles. Since the passage 63 has a large heat transfer area, the compressed gas may efficiently transfer heat to the heat exchanger 61. Moreover, in the regions 65 and 66 where the flow rate changes greatly, a great amount of heat is transferred from the compressed gas to the surrounding medium through the fins covering the regions. Therefore, the gas is cooled sufficiently fast prior to the introduction to the regenerator 7. It should be also noted that the narrow gap 63 has a reduced dead space, resulting in a large compression ratio of the gas in the expansion space 13. As pointed out earlier, this enhances the performance of the apparatus in generating low temperature in the heat exchanger 60.

This cycle is repeated by the continuous operation of the crank mechanism 18 to refrigerate the cover 60, especially the top end 60*a* thereof, which serves as a low temperature heat source for an external heat load (not shown).

Figure 8:
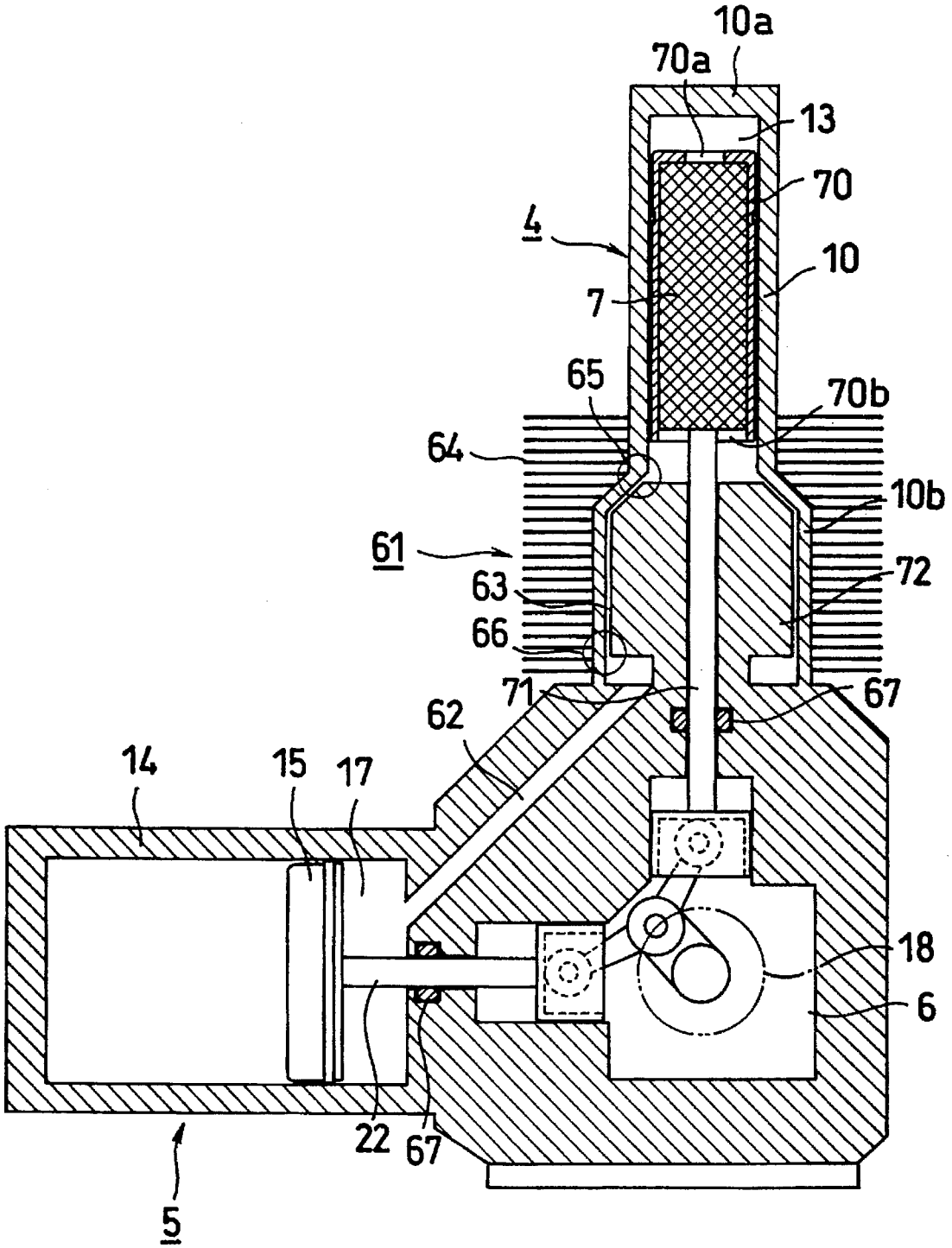
FIG. 8 is a schematic view of a Stirling refrigeration apparatus having a still further type of heat exchanger according to the invention.
Figure 9:
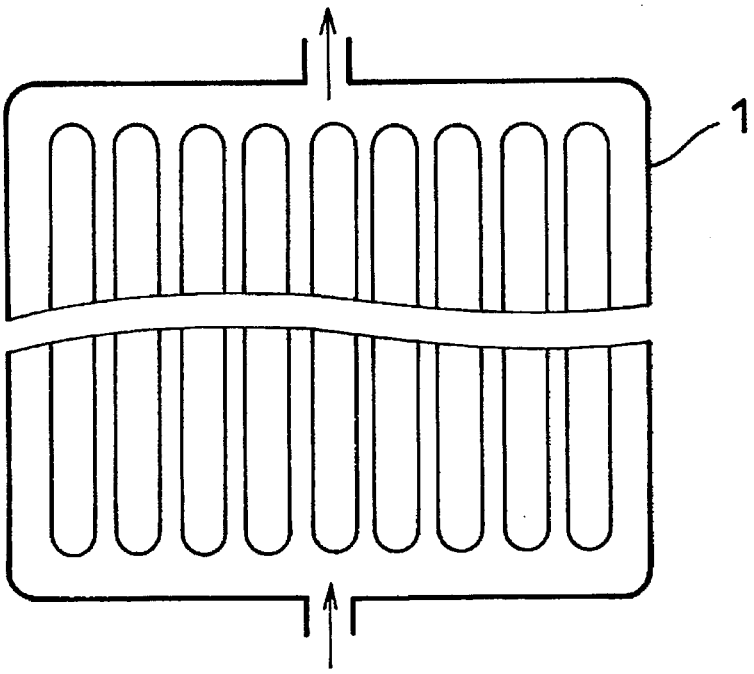
FIG. 9 PRIOR ART
FIG. 9 is a partial cross section of a conventional heat exchanger.
Figure 10:
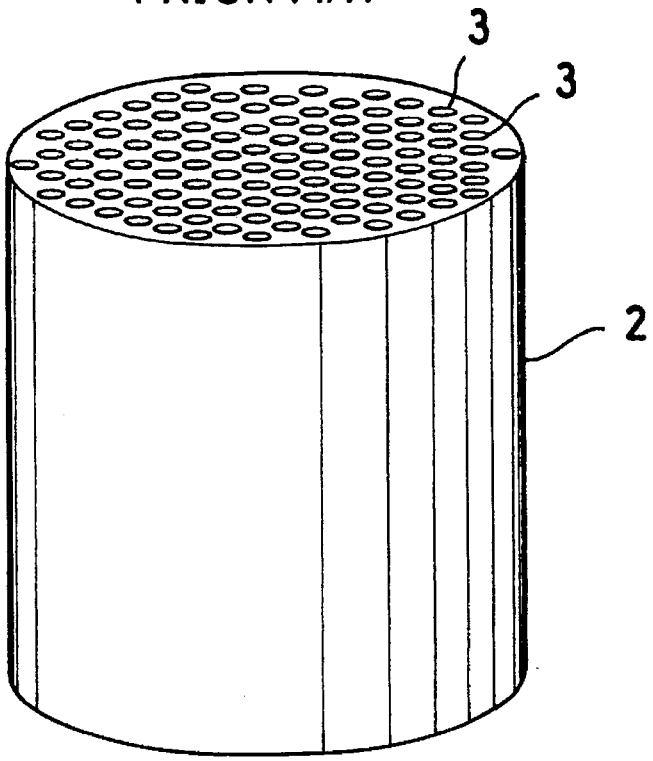
FIG. 10 PRIOR ART
FIG. 10 is a partial cross section of another conventional heat exchanger.

Referring now to FIG. 8, there is shown still another embodiment of the invention. This example has many features in common with the one shown in FIG. 7. However, this embodiment greatly differs from the preceding one in that a displacer 70 substitutes for the piston 11 of FIG. 7. The displacer 70 includes a hollow cylinder filled with a regenerator 7, as shown in FIG. 8, Thus, the displacer 70 has openings 70*a* and 70*b* at the opposite ends thereof. The displacer 70 is accommodated in an expansion cylinder 10. The displacer 70 is connected with a displacer rod 71 which is operably connected with a crank mechanism 18.

At the lower end of the expansion cylinder 10 is a bulging heat transfer cylinder 10*b* which is contiguous to with the expansion cylinder 10 but has larger diameter than the cylinder 10.

In the heat transfer cylinder 10*b* is a partition member 72 which fills most of the inner space of the expansion cylinder 10 such that a narrow gap 63 is formed communicate between the upper and lower ends of the heat transfer cylinder 10*b*. This gap is provided for the working gas to pass through it. Mounted on the outer surface of the heat transfer cylinder 10*b* is a multiplicity of fins 64 for radiating heat, The fins 64, the heat transfer cylinder 10*b*, and the partition member 72 altogether form a heat exchanger 61. It would be noted that the heat exchanger 61 has a very small dead space and that the gas transport passage 63 has a large heat transfer area (which is the entire inner surface of the bulged cylinder 10*b*).

In she example shown in FIG. 8, it should be noted that the gas passage to the compression/expansion cylinder includes: an inner space formed below the displacer when the displacer has reached its upper dead point in the cylinder 10, and portions 65 and 66 of the gas passage adjacent the opposite ends of the narrow gap 63 where the flow rate of the working gas drastically changes due to rapidly changing cross sections of the passage. As discussed in connection with FIG. 7, such abrupt change in the flow rate may provide a large heat transfer coefficient to the heat exchanger. It is for this reason that the fins 64 are distributed over these regions of the heat exchanger which correspond to the length of the narrow gap 63, the portion of the gas passage where the flow rate of the working gas abruptly changes; and the inner space of the cover formed below the displacer when the displacer has reached its upper dead point.

In operation, the piston 15 of the gas compressor 5 is moved backward in the compression cylinder 14 by the crank mechanism 18, compressing the helium gas in the compression space 17 while the displacer 70 is held virtually at rest at the upper dead point thereof in the expansion cylinder 10, in much she same way as in the apparatus shown in FIG. 7. The compressed gas is then passed to the heat exchanger 61 serving as a heat radiator via the gas passage 62, where the gas liberates a portion of its energy accumulated during the compression and is cooled to a temperature near ambient temperature. The gas is further passed through the regenerator 7 in the displacer 70 from the lower opening 70*b* of the displacer 70 and further into the expansion space 13 through an upper opening 70*a* of the displacer 70.

When the gas is introduced in the regenerator 7, it is further cooled. Thus, the expansion space 13 is filled with a cold pressurized gas.

Subsequently, the dislacer 70 is quickly lowered, causing the gas to adiabatically expand in the expansion space 13 and get cooled to a lower temperature.

Following the expansion of the gas, the displacer 70 is lifted and at the same time the piston 15 is driven forward by the crank mechanism 18, thereby forcing the expanded gas to return from the expansion space 13 to the compression space 17 via the regenerator 7 and the heat exchanger 61. In this process the regenerator 7 is cooled by the gas.

Thus, the cycle of the apparatus consists of a sequence of compression of the working gas in the compression space 17, transfer of the gas to the expansion space 13, an adiabatic expansion in the expansion space 13, and recovery of the gas in the compression space 17. This cycle is repeated by the continuous rotational motion of the crank mechanism 18 to refrigerate the upper section 60*a* of the expansion cylinder 60 and the regenerator 7. The upper section 60*a* may be used as a heat sink for an external heat load (not shown).

It should be noted that the working gas is transported back and forth through the narrow gap 63 between the extended cover 60*b* and the partition member 72 during the operation of the apparatus. Since the passage 63 has a large heat transfer area to volume ratio, the compressed gas may efficiently transfer heat to the heat exchanger 61. Moreover, in the regions 65 and 66 where the flow rate changes greatly, a great amount of heat is transferred from the compressed gas to the surrounding medium through the fins covering the regions. Therefore, the gas is cooled sufficiently fast prior to the introduction to the regenerator 7. It should be also noted that the narrow gap 63 has a reduced dead space, resulting in a large compression ratio of the gas in the expansion space 13. This enhances the performance of the apparatus in generating low temperature in the heat exchanger 4.

In summary, the invention may provide in many different ways a heat exchanger with an improved heat transfer coefficient and a lower temperature heat source than conventional ones. This is due to the fact that the heat exchanger has a large heat transfer area in the heat exchanger while reducing a dead space in the heat exchanger.

While the invention is susceptible to various modifications and alternative forms, a specific embodiment thereof has been shown by way of example in the drawings and will herein be described in detail. It should be understood, however, that it is not intended to limit the invention to the particular form disclosed, but on the contrary, the intention is to cover all modifications, equivalents, and alternatives falling within the spirit and scope of the invention as defined by the appended claims.

What is claimed is:

1. A heat exchanger for use in a gas compression/expansion apparatus for transferring heat to/from a compression/expansion space of a compression/expansion cylinder of said apparatus where a working gas is compressed/expanded, said heat exchanger comprising:

a tube connected with said compression/expansion space of said compression/expansion cylinder;

a central cylinder disposed in said tube such that a narrow gap for said working gas is formed only between said central cylinder and said tube, wherein said heat exchanger is adapted to transfer heat between said working gas in said compression/expansion space and an ambient medium surrounding said tube and serve as a low/high temperature heat source.

2. The heat exchanger as recited in claim 1, wherein said tube and said central cylinder are made of flexible materials.

3. The heat exchanger as recited in claim 1 or 2, wherein a multiplicity of fins are fitted on the exterior surface of said tube.

4. The heat exchanger as recited in claim 3, wherein said fins are mounted on said tube by:

a first step of placing each of said fins on a drawing bench having a hole slightly larger in diameter than the outer diameter of said tube, a circular fin having a central hole of a given inner diameter which is smaller than said outer diameter of said tube by a predetermined length;

a second step of pressing said tube into said hole of said fin until said fin is fitted on a predetermined position of said tube; and repeating said first and second steps until a predetermined number of fins are fitted on said tube.

5. A heat exchanger for use in a gas compression/expansion apparatus for transferring heat to/from a compression/expansion cylinder of said apparatus where a working gas is compressed/expanded, said heat exchanger comprising:

a cap member covering said compression/expansion cylinder such that a narrow gap for said working gas to pass through is formed between said cap member and said compression/expansion cylinder, said narrow gap communicates with said compression/expansion space and is accessible from an inlet of said cap, wherein said heat exchanger is adapted to transfer heat between said working gas in said compression/expansion space and an ambient medium surrounding said cap member so as to serve as a high/low temperature heat source.

6. The heat exchanger as recited in claim 5, further comprising a multiplicity of fins fitted on the exterior surface of said cap member.

7. A heat exchanger for use in a gas compression/expansion apparatus, said heat exchanger serving as a high/low temperature heat source by transferring heat between a working gas in a compression/expansion space of a compression/expansion cylinder of said apparatus, said working gas compressed/expanded in said compression/expansion space by a piston driven by a crank mechanism in a machinery room via a piston rod connected with said piston and transported through a gas passage connected with said compression/expansion cylinder, said heat exchanger comprising:

a regenerator surrounding the outer surface of said compression/expansion cylinder;

an exterior cover for covering said regenerator and said cylinder, said cylinder having an opening at the distal end thereof for communicating with said compression/expansion space;

a partition member which surrounds said piston rod and is disposed between said cylinder and said machinery room, such that a narrow gap is formed between said partition member and said cover for allowing said working gas to pass through.

8. The heat exchanger as recited in claim 7, wherein fins are provided on the regions of the exterior surface of said cover, said regions corresponding to:

the length of said narrow gap;

a portion of said gas passage where the flow rate of said working gas abruptly changes; and an inner space of said cover formed below said regenerator.

9. A heat exchanger for use in a gas compression/expansion apparatus, including a gas compressor having a piston and a compression space for compressing a working gas and a gas expander having a displacer and an expansion space for expanding said working gas, said compression space connected with said expansion space via a gas passage, said piston and said displacer driven by a crank mechanism out of phase by a predetermined phase, and said heat exchanger serving as a low temperature heat source by transferring heat to said working gas expanded in said expansion space, said heat exchanger comprising:

a heat transfer cylinder contiguous with said expansion cylinder;

a partition member which surrounds a piston rod of said piston and is disposed in said heat transfer cylinder and between said expansion cylinder and said machinery room, such that a narrow gap is formed between said partition member and said heat transfer cylinder for allowing said working gas to pass through, said gap communicating with said expansion space via said regenerator; and a gas transitional area for communication between said gap and said compression space of said compression cylinder.

10. The heat exchanger as recited in claim 9, further comprising fins provided on the regions of the exterior surface of said cover, said regions corresponding to:

the length of said narrow gap;

a portion of said gas passage where the flow rate of said working gas abruptly changes; and an inner space of said cover formed below said displacer when said displacer has reached its upper dead point.

11. A heat exchanger for use in an apparatus which includes both a gas compressor and a gas expander so that said heat exchanger serves as both a high temperature heat source and a low temperature heat source, respectively, by transferring heat between a working gas in a compression space and an expansion space, respectively, of a compression cylinder and an expansion cylinder, respectively, of said apparatus, said working gas compressed and expanded, respectively, in said compression space and said expansion space, respectively, by a piston driven by a crank mechanism in a machinery room via a piston rod connected with said piston and transported through a gas passage connected with said compression cylinder and said expansion cylinder, respectively, said heat exchanger comprising:

a regenerator surrounding an outer surface of said expansion cylinder;

a exterior cover means for covering said regenerator and said expansion cylinder, said expansion cylinder having an opening at the distal end thereof for communicating with said expansion space;

a heat transfer cylinder contiguous with said expansion cylinder;

a partition member which surrounds a piston rod of said piston and is disposed in said heat transfer cylinder between said expansion cylinder and said machinery room such that a narrow gap is formed between said partition member and said heat transfer cylinder for allowing said working gas to pass therethrough, said gap communicating with said expansion space via an arrangement of transitional portions and said regenerator;

a gas transitional area for communication between said gap and said compression space of said compression cylinder; and wherein said compression cylinder having at a base section thereof said compression space which communicates with said heat exchanger of said expansion cylinder.

* * * * *